US010054968B2

(12) United States Patent
Kamath et al.

(10) Patent No.: US 10,054,968 B2
(45) Date of Patent: Aug. 21, 2018

(54) AREA-EFFICIENT HIGH-ACCURACY BANDGAP VOLTAGE REFERENCE CIRCUIT

(71) Applicant: Xilinx, Inc., San Jose, CA (US)

(72) Inventors: Umanath R. Kamath, Citywest (IE); John K. Jennings, Glenageary (IE)

(73) Assignee: XILINX, INC., San Jose, CA (US)

( * ) Notice: Subject to any disclaimer, the term of this patent is extended or adjusted under 35 U.S.C. 154(b) by 71 days.

(21) Appl. No.: 15/266,947

(22) Filed: Sep. 15, 2016

(65) Prior Publication Data

US 2018/0074533 A1 Mar. 15, 2018

(51) Int. Cl.

| | |
|---|---|
| ***G05F 1/10*** | (2006.01) |
| ***G05F 3/02*** | (2006.01) |
| ***G05F 1/46*** | (2006.01) |

(52) U.S. Cl.

CPC ..... *G05F 1/468* (2013.01)

(58) Field of Classification Search

CPC . G05F 3/30; G05F 3/267; G05F 3/262; G05F 3/205; G11C 5/147

USPC ..... 327/539, 512, 513; 323/313

See application file for complete search history.

(56) References Cited

U.S. PATENT DOCUMENTS 5,059,820 A * 10/1991 Westwick ..... G05F 3/30 323/314
6,445,238 B1 9/2002 Lesea
6,683,481 B1 1/2004 Zhou et al.
6,819,163 B1 * 11/2004 Gregoire, Jr. ..... G05F 3/262 327/536
7,225,099 B1 5/2007 Dwyer
7,307,468 B1 12/2007 Vasudevan
7,321,256 B1 1/2008 Vasudevan
7,400,123 B1 7/2008 Voogel
7,859,918 B1 12/2010 Nguyen et al.
8,638,084 B1 1/2014 Abugharbieh et al.
9,013,231 B1 * 4/2015 Manea ..... G05F 3/08 327/539

OTHER PUBLICATIONS

Hironori Banba et al., A CMOS Bandgap Reference Circuit with Sub-1-V Operation, IEEE Journal of Solid-State Circuits, vol. 34, No. 5, May 1999, pp. 670-674.

Karel E. Kuijk, A Precision Reference Voltage Source, IEEE Journal of Solid-State Circuits, vol. SC-8, No. 3, Jun. 1973, pp. 222.

* cited by examiner

*Primary Examiner* — Quan Tra
(74) *Attorney, Agent, or Firm* — David O'Brien; Hong Shi; Craige Thompson

(57) ABSTRACT

An integrated circuit includes a reference voltage circuit. The reference voltage circuit includes a bipolar junction transistor (BJT) configured to receive a first current during a first phase of a clock cycle to generate a first base-emitter junction voltage, and receive a second current during a second phase of the clock cycle to generate a second base-emitter junction voltage. The reference voltage circuit includes a switched capacitor circuit configured to provide a reference voltage associated with the first base-emitter junction voltage and the second base-emitter junction voltage.

18 Claims, 13 Drawing Sheets

AREA-EFFICIENT HIGH-ACCURACY BANDGAP VOLTAGE REFERENCE CIRCUIT

FIELD

Examples of the present disclosure generally relate to integrated circuits ("ICs") and, in particular, to an embodiment related to ICs generating a reference voltage that is temperature independent.

BACKGROUND

A bandgap voltage circuit is a temperature independent voltage reference circuit widely used in integrated circuits. For example, an analog-to-digital converter (ADC) may have at least two inputs, namely a voltage to be measured and a reference voltage. A bandgap voltage generated by the bandgap voltage circuit may be provided to the ADC as the reference voltage for a full scale comparison for the voltage to be measured.

Generally, in the bandgap voltage circuit, two bipolar junction transistors (BJTs) may operate at different current densities and generate different base-emitter junction voltages. Difference between these different base-emitter junction voltages may have a proportional to absolute temperature (PTAT) dependency. By using these base-emitter junction voltages generated by different BJTs, a first order temperature independent voltage may be generated. However, such bandgap voltage circuit requires a high supply voltage (e.g., of about 1.5 Volts or higher), uses a large area (e.g., because of the associated BJT matching requirement), and may have inaccuracies caused by various associated circuits. Accordingly, it would be desirable and useful to provide an improved way of providing a reference voltage.

SUMMARY

In some embodiments in accordance with the present disclosure, an integrated circuit includes a reference voltage circuit. The reference voltage circuit includes a bipolar junction transistor (BJT) configured to receive a first current during a first phase of a clock cycle to generate a first base-emitter junction voltage; and receive a second current during a second phase of the clock cycle to generate a second base-emitter junction voltage. The reference voltage circuit further includes a switched capacitor circuit configured to provide a reference voltage associated with the first base-emitter junction voltage and the second base-emitter junction voltage.

In some embodiments, the reference voltage circuit is coupled to a supply voltage less than about 1.5 volts.

In some embodiments, the switched capacitor circuit includes a first capacitor configured to store a first charge associated with the first base-emitter junction voltage during the first phase, and a second capacitor configured to store a second charge associated with a difference between the first and second base-emitter junction voltages during the second phase. During a third phase of the clock cycle, the first charge and the second charge are redistributed between the first and second capacitors.

In some embodiments, the reference voltage circuit includes an operational amplifier having a first input, a second input, and an output. The first input of the operational amplifier is coupled to the first capacitor. The second input of the operational amplifier is coupled to the second capacitor. The output of the operational amplifier provides a buffered version of the reference voltage (also referred to as a true reference voltage). The true reference voltage is produced on the positive input of the operational amplifier during the third phase of the clock cycle. The operational amplifier is configured as a unity gain buffer so that the buffered version of the true reference voltage appears on the output of the amplifier output. In some embodiments, the buffered version of the true reference voltage includes buffering errors associated with the operational amplifier.

In some embodiments, the reference voltage is equal to or less than a bandgap voltage of about 1.2 volts.

In some embodiments, the reference voltage circuit includes a fraction control circuit coupled to the first capacitor. The fraction control circuit is configured to determine a ratio of the reference voltage to the bandgap voltage.

In some embodiments, the fraction control circuit includes one or more fraction control capacitors, each fraction control capacitor coupled to a fraction control switch. The fraction control circuit is configured to receive a fraction control signal. Each fraction control switch is controlled by a bit of the fraction control signal.

In some embodiments, the reference voltage is first order temperature independent.

In some embodiments, the integrated circuit includes an analog-to-digital converter (ADC) having a first input, a second input, and a first output. The first input of the ADC is configured to receive an analog voltage signal. The second input of the ADC is configured to receive the reference voltage. The first output of the ADC provides a digital signal corresponding to the analog voltage signal.

In some embodiments, the ADC includes a second output providing the fraction control signal to the fraction control circuit.

In some embodiments in accordance with the present disclosure, a method includes receiving, by a bipolar junction transistor (BJT), a first current during a first phase of a clock cycle to generate a first base-emitter junction voltage; receiving, by the BJT, a second current during a second phase of the clock cycle to generate a second base-emitter junction voltage; and providing, by a switched capacitor circuit, a reference voltage associated with the first base-emitter junction voltage and the second base-emitter junction voltage.

In some embodiments, the method includes receiving a supply voltage less than about 1.5 volts.

In some embodiments, the providing a reference voltage associated with the first base-emitter junction voltage and the second base-emitter junction voltage includes storing, by a first capacitor of the switched capacitor circuit, a first charge associated with the first base-emitter junction voltage during the first phase; storing, by a second capacitor of the switched capacitor circuit, a second charge associated with a difference between the first and second base-emitter junctions during the second phase; and redistributing, between the first and second capacitors, the first charge and the second charge during a third phase of the clock cycle.

In some embodiments, the method includes coupling the first capacitor to a first input of an operational amplifier; coupling the second capacitor to a second input of the operational amplifier; and providing the reference voltage using an output of the operational amplifier.

In some embodiments, the method includes determining a ratio of the reference voltage to the bandgap voltage using a fraction control circuit coupled to the first capacitor.

In some embodiments, the method includes receiving, by the fraction control circuit, a fraction control signal. The fraction control circuit includes one or more fraction control capacitors, each fraction control capacitor coupled to a fraction control switch. Each fraction control switch is controlled by a bit of the fraction control signal.

In some embodiments, the method includes providing an analog signal to a first input of an analog-to-digital converter (ADC); providing the reference voltage to a second input of the ADC; and generating, through a first output of the ADC, a digital signal corresponding to the analog signal.

In some embodiments, the method includes receiving, by the fraction control circuit from the ADC, the fraction control signal.

Other aspects and features will be evident from reading the following detailed description and accompanying drawings.

DETAILED DESCRIPTION

Figure 1:
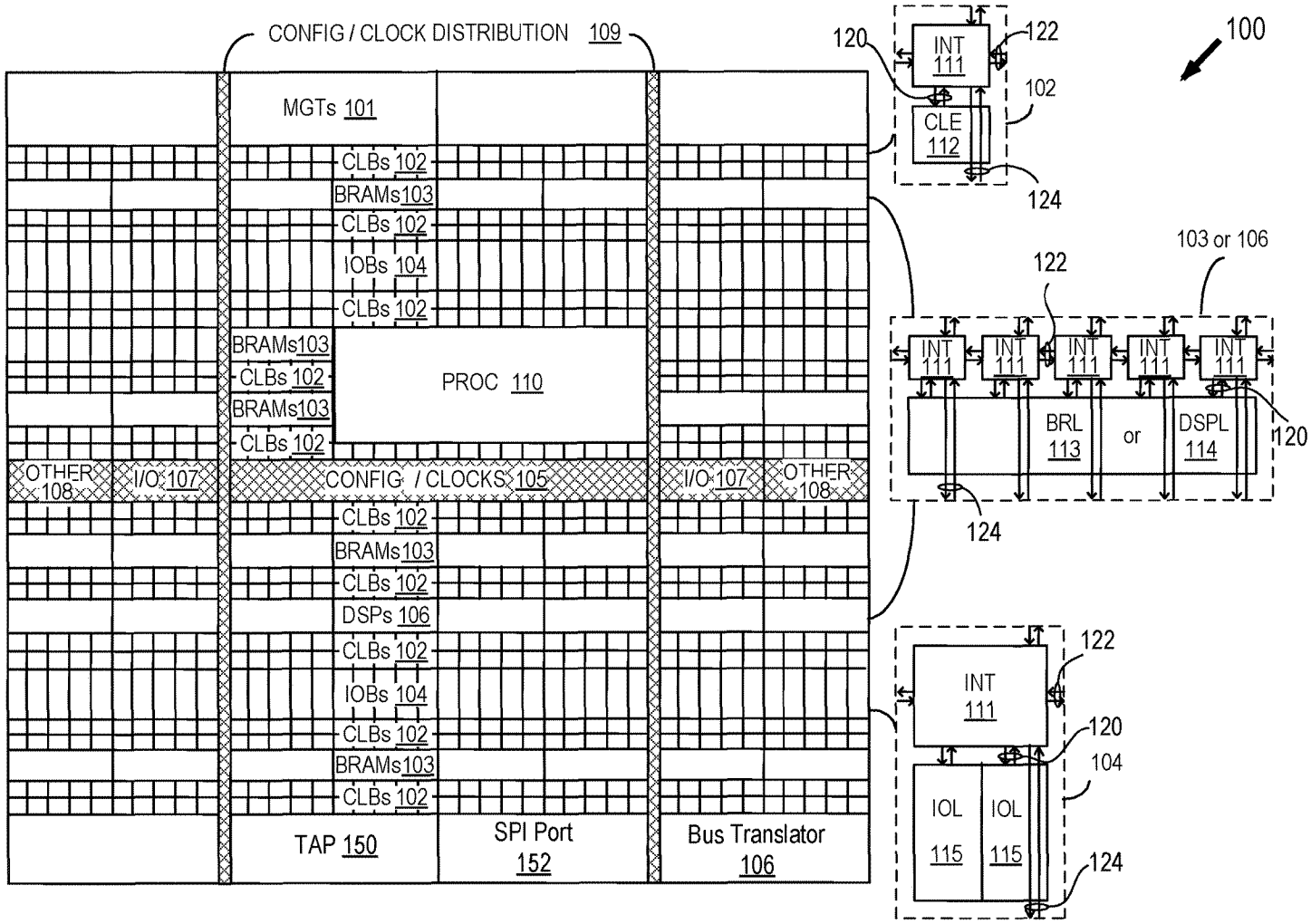
FIG. 1 is a block diagram illustrating an exemplary architecture for an IC according to some embodiments of the present disclosure.

Various embodiments are described hereinafter with reference to the figures, in which exemplary embodiments are shown. The claimed invention may, however, be embodied in different forms and should not be construed as being limited to the embodiments set forth herein. Like reference numerals refer to like elements throughout. Like elements will, thus, not be described in detail with respect to the description of each figure. It should also be noted that the figures are only intended to facilitate the description of the embodiments. They are not intended as an exhaustive description of the claimed invention or as a limitation on the scope of the claimed invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or if not so explicitly described. The features, functions, and advantages may be achieved independently in various embodiments or may be combined in yet other embodiments.

Before describing exemplary embodiments illustratively depicted in the several figures, a general introduction is provided to further understanding. To generate a temperature independent voltage, different currents may be injected into a bipolar junction transistor (BJT) during different phases, thereby generating different base-emitter junction voltages using one BJT. Weighted sum of these base-emitter junction voltages may provide a first order temperature independent voltage (also known as bandgap voltage of about 1.2 volts). Furthermore, a reference voltage having any fraction of a bandgap voltage may be generated dynamically, which may be used in analog-to-digital conversion (e.g. in a generic instrumentation ADC) requiring that the reference voltage is adapted according to an input signal of the ADC.

With the above general understanding borne in mind, various embodiments for reference voltage generation are generally described below. While the description below is directed at particular examples implemented with configurable (or programmable) hard macros, other applications (e.g., with software implementations) where reference voltages may be required may benefit from the present disclosure as described herein.

Because one or more of the above-described embodiments are exemplified using a particular type of IC, a detailed description of such an IC is provided below. However, it should be understood that other types of ICs may benefit from one or more of the embodiments described herein.

Programmable logic devices ("PLDs") are a well-known type of integrated circuit that can be programmed to perform specified logic functions. One type of PLD, the field programmable gate array ("FPGA"), typically includes an array of programmable tiles. These programmable tiles can include, for example, input/output blocks ("IOBs"), configurable logic blocks ("CLBs"), dedicated random access memory blocks ("BRAMs"), multipliers, digital signal processing blocks ("DSPs"), processors, clock managers, delay lock loops ("DLLs"), and so forth. As used herein, "include" and "including" mean including without limitation.

Each programmable tile typically includes both programmable interconnect and programmable logic. The programmable interconnect typically includes a large number of interconnect lines of varying lengths interconnected by programmable interconnect points ("PIPs"). The programmable logic implements the logic of a user design using programmable elements that can include, for example, function generators, registers, arithmetic logic, and so forth.

The programmable interconnect and programmable logic are typically programmed by loading a stream of configuration data into internal configuration memory cells that define how the programmable elements are configured. The configuration data can be read from memory (e.g., from an external PROM) or written into the FPGA by an external device. The collective states of the individual memory cells then determine the function of the FPGA.

Another type of PLD is the Complex Programmable Logic Device, or CPLD. A CPLD includes two or more "function blocks" connected together and to input/output ("I/O") resources by an interconnect switch matrix. Each function block of the CPLD includes a two-level AND/OR structure similar to those used in Programmable Logic Arrays ("PLAs") and Programmable Array Logic ("PAL")

devices. In CPLDs, configuration data is typically stored on-chip in non-volatile memory. In some CPLDs, configuration data is stored on-chip in non-volatile memory, then downloaded to volatile memory as part of an initial configuration (programming) sequence.

In general, each of these programmable logic devices ("PLDs"), the functionality of the device is controlled by configuration data provided to the device for that purpose. The configuration data can be stored in volatile memory (e.g., static memory cells, as common in FPGAs and some CPLDs), in non-volatile memory (e.g., FLASH memory, as in some CPLDs), or in any other type of memory cell.

Other PLDs are programmed by applying a processing layer, such as a metal layer, that programmably interconnects the various elements on the device. These PLDs are known as mask programmable devices. PLDs can also be implemented in other ways, e.g., using fuse or antifuse technology. The terms "PLD" and "programmable logic device" include but are not limited to these exemplary devices, as well as encompassing devices that are only partially programmable. For example, one type of PLD includes a combination of hard-coded transistor logic and a programmable switch fabric that programmably interconnects the hard-coded transistor logic.

As noted above, advanced FPGAs can include several different types of programmable logic blocks in the array. For example, FIG. 1 illustrates an exemplary FPGA architecture 100. The FPGA architecture 100 includes a large number of different programmable tiles, including multigigabit transceivers ("MGTs") 101, configurable logic blocks ("CLBs") 102, random access memory blocks ("BRAMs") 103, input/output blocks ("IOBs") 104, configuration and clocking logic ("CONFIG/CLOCKS") 105, digital signal processing blocks ("DSPs") 106, specialized input/output blocks ("I/O") 107 (e.g., configuration ports and clock ports), and other programmable logic 108 such as digital clock managers, analog-to-digital converters, system monitoring logic, and so forth. Some FPGAs also include dedicated processor blocks ("PROC") 110.

In some FPGAs, each programmable tile can include at least one programmable interconnect element ("INT") 111 having connections to input and output terminals 120 of a programmable logic element within the same tile, as shown by examples included at the top of FIG. 1. Each programmable interconnect element 111 can also include connections to interconnect segments 122 of adjacent programmable interconnect element(s) in the same tile or other tile(s). Each programmable interconnect element 111 can also include connections to interconnect segments 124 of general routing resources between logic blocks (not shown). The general routing resources can include routing channels between logic blocks (not shown) comprising tracks of interconnect segments (e.g., interconnect segments 124) and switch blocks (not shown) for connecting interconnect segments. The interconnect segments of the general routing resources (e.g., interconnect segments 124) can span one or more logic blocks. The programmable interconnect elements 111 taken together with the general routing resources implement a programmable interconnect structure ("programmable interconnect") for the illustrated FPGA.

In an example implementation, a CLB 102 can include a configurable logic element ("CLE") 112 that can be programmed to implement user logic plus a single programmable interconnect element ("INT") 111. A BRAM 103 can include a BRAM logic element ("BRL") 113 in addition to one or more programmable interconnect elements. Typically, the number of interconnect elements included in a tile depends on the height of the tile. In the pictured example, a BRAM tile has the same height as five CLBs, but other numbers (e.g., four) can also be used. A DSP tile 106 can include a DSP logic element ("DSPL") 114 in addition to an appropriate number of programmable interconnect elements. An 10B 104 can include, for example, two instances of an input/output logic element ("IOL") 115 in addition to one instance of the programmable interconnect element 111. As will be clear to those of skill in the art, the actual I/O pads connected, for example, to the I/O logic element 115 typically are not confined to the area of the input/output logic element 115.

In the example of FIG. 1, an area (depicted horizontally) near the center of the die (e.g., formed of regions 105, 107, and 108 shown in FIG. 1) can be used for configuration, clock, and other control logic. Column 109 (depicted vertically) extending from this horizontal area or other columns may be used to distribute the clocks and configuration signals across the breadth of the FPGA.

Some FPGAs utilizing the architecture illustrated in FIG. 1 include additional logic blocks that disrupt the regular columnar structure making up a large part of the FPGA. The additional logic blocks can be programmable blocks and/or dedicated logic. For example, PROC 110 spans several columns of CLBs and BRAMs. PROC 110 can include various components ranging from a single microprocessor to a complete programmable processing system of microprocessor(s), memory controllers, peripherals, and the like.

In one aspect, PROC 110 is implemented as a dedicated circuitry, e.g., as a hard-wired processor, that is fabricated as part of the die that implements the programmable circuitry of the IC. PROC 110 can represent any of a variety of different processor types and/or systems ranging in complexity from an individual processor, e.g., a single core capable of executing program code, to an entire processor system having one or more cores, modules, co-processors, interfaces, or the like.

In another aspect, PROC 110 is omitted from architecture 100, and may be replaced with one or more of the other varieties of the programmable blocks described. Further, such blocks can be utilized to form a "soft processor" in that the various blocks of programmable circuitry can be used to form a processor that can execute program code, as is the case with PROC 110.

The phrase "programmable circuitry" can refer to programmable circuit elements within an IC, e.g., the various programmable or configurable circuit blocks or tiles described herein, as well as the interconnect circuitry that selectively couples the various circuit blocks, tiles, and/or elements according to configuration data that is loaded into the IC. For example, portions shown in FIG. 1 that are external to PROC 110 such as CLBs 102 and BRAMs 103 can be considered programmable circuitry of the IC.

In some embodiments, the functionality and connectivity of programmable circuitry are not established until configuration data is loaded into the IC. A set of configuration data can be used to program programmable circuitry of an IC such as an FPGA. The configuration data is, in some cases, referred to as a "configuration bitstream." In general, programmable circuitry is not operational or functional without first loading a configuration bitstream into the IC. The configuration bitstream effectively implements or instantiates a particular circuit design within the programmable circuitry. The circuit design specifies, for example, functional aspects of the programmable circuit blocks and physical connectivity among the various programmable circuit blocks.

In some embodiments, circuitry that is "hardwired" or "hardened," i.e., not programmable, is manufactured as part of the IC. Unlike programmable circuitry, hardwired circuitry or circuit blocks are not implemented after the manufacture of the IC through the loading of a configuration bitstream. Hardwired circuitry is generally considered to have dedicated circuit blocks and interconnects, for example, that are functional without first loading a configuration bitstream into the IC, e.g., PROC 110.

In some instances, hardwired circuitry can have one or more operational modes that can be set or selected according to register settings or values stored in one or more memory elements within the IC. The operational modes can be set, for example, through the loading of a configuration bitstream into the IC. Despite this ability, hardwired circuitry is not considered programmable circuitry as the hardwired circuitry is operable and has a particular function when manufactured as part of the IC.

FIG. 1 is intended to illustrate an exemplary architecture that can be used to implement an IC that includes programmable circuitry, e.g., a programmable fabric. For example, the numbers of logic blocks in a row, the relative width of the rows, the number and order of rows, the types of logic blocks included in the rows, the relative sizes of the logic blocks, and the interconnect/logic implementations included at the top of FIG. 1 are purely exemplary. For example, in an actual IC, more than one adjacent row of CLBs is typically included wherever the CLBs appear, to facilitate the efficient implementation of user logic, but the number of adjacent CLB rows varies with the overall size of the IC. Moreover, the FPGA of FIG. 1 illustrates one example of a programmable IC that can employ examples of the interconnect circuits described herein. The interconnect circuits described herein can be used in other types of programmable ICs, such as complex programmable logic devices (CPLDs) or any type of programmable IC having a programmable interconnect structure for selectively coupling logic elements.

It is noted that the IC that may implement the reference voltage generation is not limited to the exemplary IC depicted in FIG. 1, and that IC having other configurations, or other types of IC, may also implement the reference voltage generation.

Figure 2:
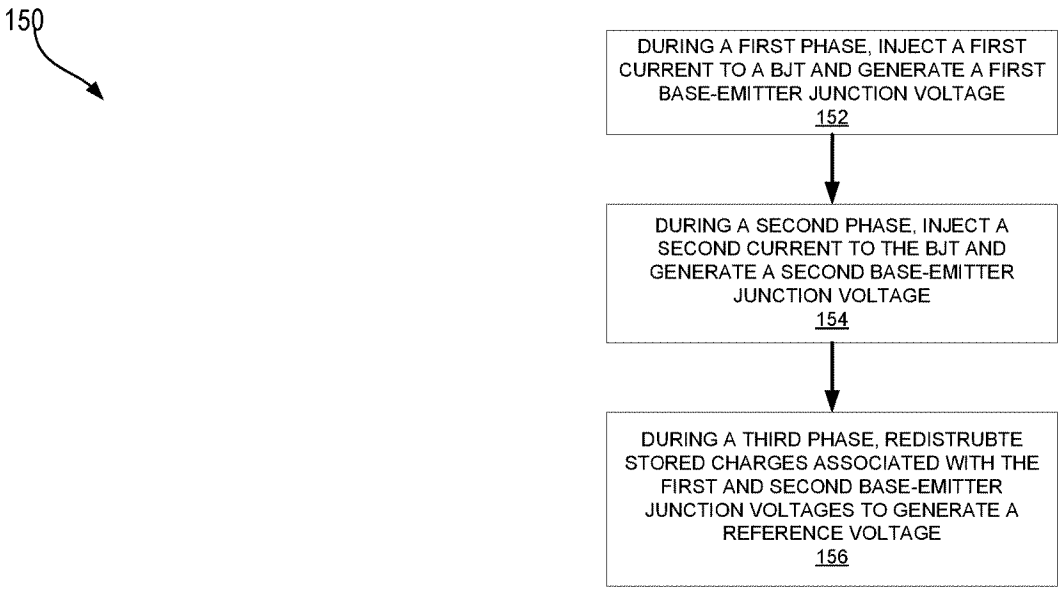
FIG. 2 is a flow chart illustrating a method for generating a reference voltage according to some embodiments of the present disclosure.
Figure 3:
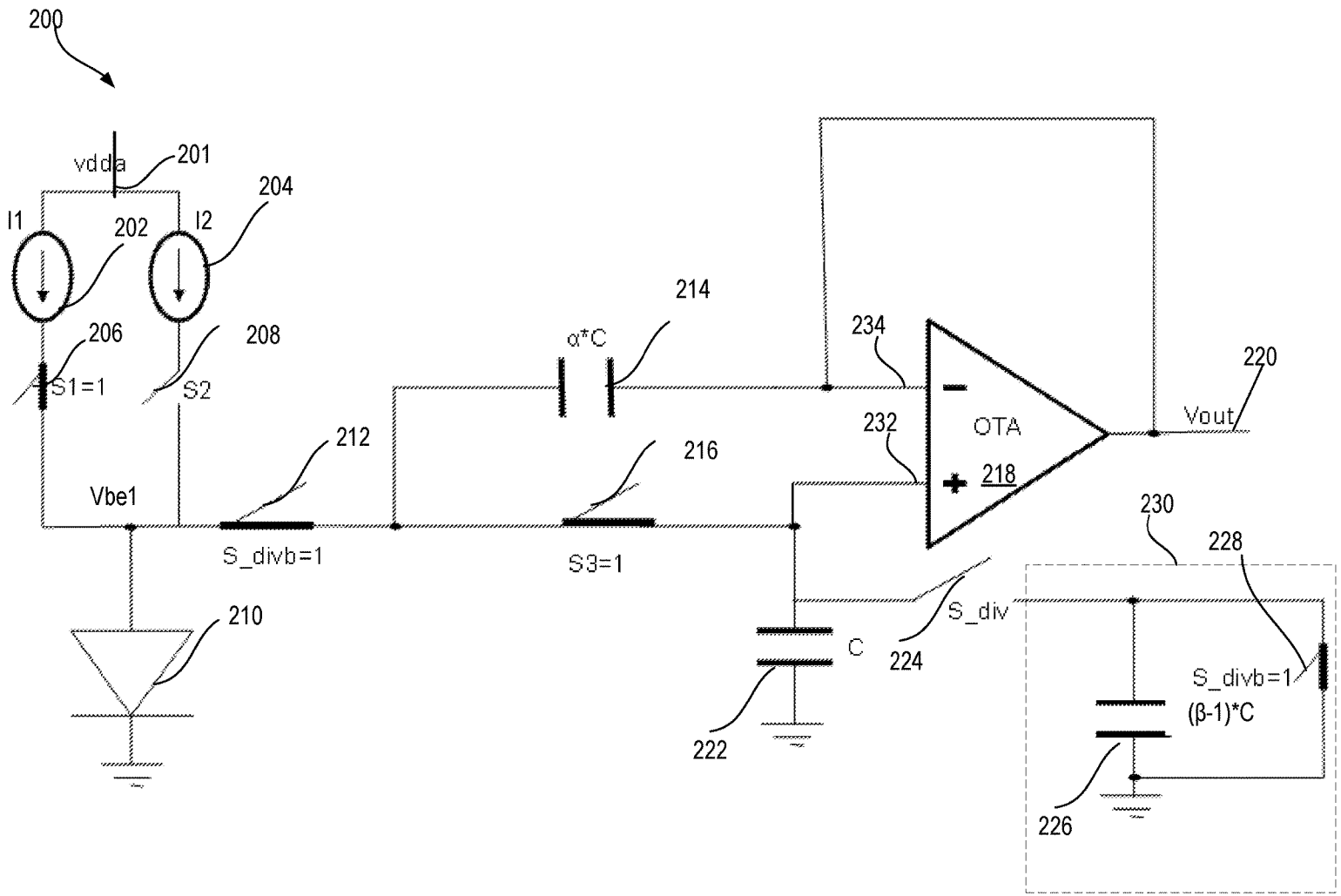
FIG. 3 is a block diagram illustrating an exemplary reference voltage circuit according to some embodiments of the present disclosure.

Referring to FIG. 2, illustrated is a method 150 for generating a reference voltage. Referring to FIGS. 2 and 3, the method 150 begins at block 152, where a first current is injected in a bipolar junction transistor (BJT) during a first phase of a clock cycle, and a first base-emitter junction voltage is generated. Referring to FIG. 3, illustrated is a reference voltage circuit 200 operating at block 152. As illustrated in the example of FIG. 3, the reference voltage circuit 200 receives a power supply voltage (Vdda) 201 to support the various components of the reference voltage circuit 200 (e.g., supporting the operational amplifier 218, providing different currents to the BJT 210). In various embodiments, the Vdda 201 may be less than 1.5V. In an example, the Vdda 201 is less than about 1.2V (e.g., equal to or less than about 0.9V). Such lower power supply voltage Vdda 201 may be achieved because a redistribution process to achieve temperature independence is performed in the charge domain. In some embodiments, the power supply voltage Vdda 201 depends on design parameters (e.g., required base-emitter voltages of the BJT 210, required voltage headroom by the current sources 202 and 204 and/or the operational amplifier 218), process conditions, and/or temperature. In an example, the required base-emitter voltages of the BJT 210 are between about 0.4V and about 0.7V, and the voltage headroom of the current sources 202 and 204 and/or the operational amplifier 218 is between about 0.1V to 0.2V. In such an example, Vdda 201 is about 0.9V determined by adding the maximum required base-emitter voltage (e.g., about 0.7V) and the maximum required voltage headroom (e.g., about 0.2V).

The reference voltage circuit 200 includes a bipolar junction transistor (BJT) 210. In an example, the BJT 210 is configured as a diode (e.g., by connecting the base and collector of the BJT). The BJT 210 is connected to switches 206 (51) and 208 (S2). By changing the states of switches 206 and 208, different currents may be injected in the BJT 210 during different phases. As illustrated in FIG. 3, at block 152, the switch 206 is on and the switch 208 is off. As such, a first current 202 (I1) is injected to the BJT 210. At block 152, the BJT 210 has a first base-emitter junction voltage Vbe1.

In some embodiments, the base of the BJT 210 is connected to a switch 212 (S_divb). The switch 212 is connected to a switch 216 (S3), which is connected to a first terminal of a first capacitor 222. At block 152, both switches 212 and 216 are on, thereby charging the first capacitor 222 having a capacitance C with a first base-emitter junction voltage Vbe1. The charge stored in the first capacitor 222 is C*Vbe1. At block 152, the buffer configuration of the operational amplifier 218 ensures that the parasitic capacitors of the operational amplifier 218 are also charged to Vbe1.

In some embodiments, the first terminal of the first capacitor 222 is coupled to a positive input 232 of an operational amplifier 218. In a subsequent step described in detail below, a reference voltage is produced at the positive input 232 of the operational amplifier 218 during a third phase of a clock cycle. The reference voltage provided at the positive input 232 in a subsequent step may be equal to or be a fraction of a bandgap voltage (e.g., about 1.2V) and may be referred to as a fractional bandgap voltage. In some embodiments, the operational amplifier 218 may be configured as a unity gain buffer, such that a buffered version of the reference voltage of the positive input 232 may be provided at an output 220 ($V_{out}$) of the operational amplifier 218. In some examples, the buffered version of the reference voltage provided at the output 220 may include buffering errors generated by the operational amplifier 218. In some embodiments, the buffered reference voltage provided at the output 220 in a subsequent step may be equal to or be a fraction of a bandgap voltage (e.g., about 1.2V) and may be referred to as a fractional bandgap voltage 220 or a reference voltage 220.

In some embodiments, a negative input 234 of the operational amplifier 218 is coupled to a first terminal of a second capacitor 214. The second capacitor 214 may have a capacitance $\alpha$*C. The capacitor ratio $\alpha$ may be chosen to obtain first order temperature independence for the reference voltage that will be provided at the output 220 of the operational amplifier 218 in subsequent steps. In some embodiments, the capacitor ratio $\alpha$ is between about 9 and 10. In an example, the capacitor ratio $\alpha$ is about 9.7.

In some embodiments, the reference voltage circuit 200 includes a fraction control circuit 230, which may be used to control a ratio between the reference voltage 220 and a bandgap voltage in subsequent steps, which will be described in detail below. In some embodiments, such fraction control circuit may be omitted in the reference voltage circuit 200. In the example of FIG. 3, the fraction control circuit 230 includes a capacitor 226 having a capacitance ($\beta$−1)*C. In an example, $\beta$ has a value equal to two, and the capacitor 226 has a capacitance C. At block 152, the switch 228 is on, such that the two terminals of the capacitor 226 are connected. At this stage, the switch 224 is off, and the first capacitor 222 is not connected to the fraction control circuit 230.

Figure 4:
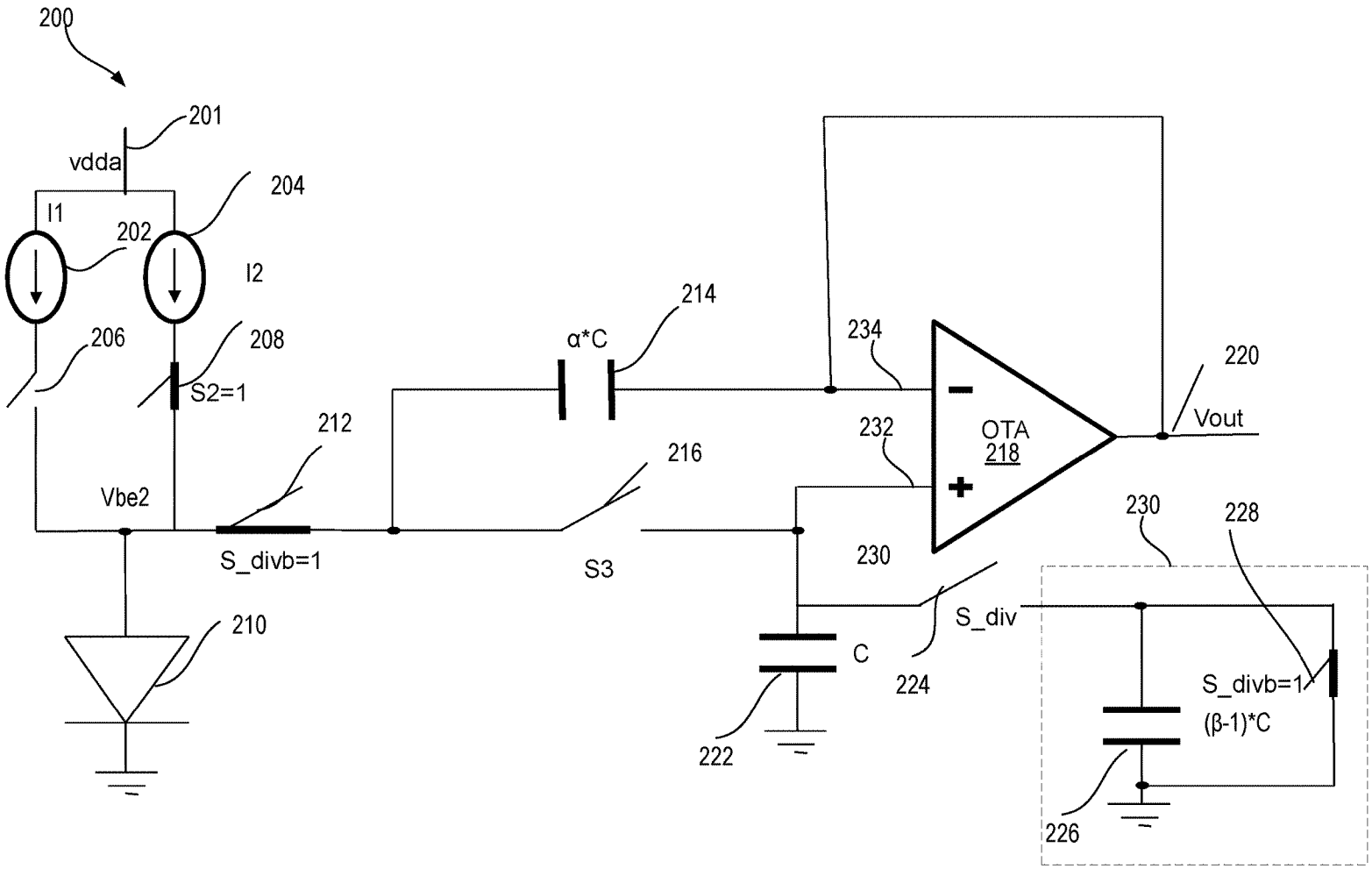
FIG. 4 is a block diagram illustrating an exemplary reference voltage circuit according to some embodiments of the present disclosure.

Referring to FIGS. 2 and 4, the method 150 proceeds to block 154, where a second current is injected in the BJT during a second phase of the clock cycle, and a second base-emitter junction voltage is generated. Referring to the example of FIG. 4, at block 154, the states of switches 206, 208, and 216 are changed. At block 154, the switch 206 is off, and the switch 208 is on, such that a second current 204 (I2) is injected in the BJT 210. In some embodiments, the ratio of I1:I2 is 1:M, where M is a positive integer chosen to obtain first order temperature independence for the reference voltage. At block 154, the BJT 210 has a second base-emitter voltage Vbe2, where a voltage ΔVbe is the difference between Vbe1 and Vbe2.

In some examples, the ΔVbe is proportional to absolute temperature (PTAT). The first base-emitter voltage Vbe1 may be complementary to absolute temperature inversely (CTAT) (inversely proportional to absolute temperature), where the Vbe1 drops at −2 mV/K when temperature increases. As such, the PTAT ΔVbe, together with the capacitor ratio α and the bias current ratio 1:M, may be used to compensate for the CTAT Vbe1. In an example, the capacitor ratio α and the bias current ratio 1:M satisfies the following equation: α*In(M)*PTAT ΔVbe slope=CTAT Vbe1 slope, where the PTAT ΔVbe slope is a slope of ΔVbe with regard to the temperature, and the CTAT Vbe1 slope is a slope of Vbe1 with regard to the temperature.

At block 154, the switch 212 remains on, while the switch 216 is off. As such, the base of the BJT 210 is coupled to a second terminal of the second capacitor 214. At block 154, the buffer configuration of the operational amplifier 218 ensures that the parasitic capacitors of the operational amplifier 218 are also charged to Vbe1. In such embodiments, the second capacitor 214 is charged with a voltage ΔVbe, which is the difference between Vbe1 and Vbe2. The charge stored in the second capacitor 214 is α*C*ΔVbe.

At block 154, the switch 224 remains off, such that the first terminal of the first capacitor 222 is not connected to the fraction control circuit 230. The switch 228 remains on, such that the two terminals of the capacitor 226 remain connected.

Referring to FIGS. 2, 5A, 5B, 5C, and 5D, the method 150 proceeds to block 156, where during a third phase of the clock cycle, the stored charges in the first capacitor and second capacitor are redistributed, thereby generating a desired reference voltage at the positive input 232 of the operational amplifier 218. Vout 220 of the operational amplifier 218 may provide a buffered version of this reference voltage of the positive input 232. In various embodiments, it depends on the application of an application circuit using the reference voltage to determine whether to use the reference voltage provided at the positive input 232 directly, or to use the buffered reference voltage provided at Vout 220 (e.g., because of loading effects). The reference voltage provided at the positive input 232 directly may yield a more accurate reference voltage, while the buffered reference voltage provided at Vout 220 may have additional buffer errors introduced by the operational amplifier 218.

In some embodiments, an application circuit (e.g., an ADC) uses the more accurate reference voltage $V_{x2}$ provided at the positive input 232 as a reference voltage. In such embodiments, after the redistribution of the stored charges in the first and second capacitors is completed (e.g., after the third phase of the clock cycle) and a desired reference voltage is provided at the positive input 232, the operational amplifier 218 may be used as a part of a circuit other than reference voltage circuit 200. In other words, different circuits may share the operational amplifier 218. In an example, during a first time period, the operational amplifier 218 may perform a first function associated with the reference voltage circuit 200 (e.g., performing an auxiliary operation to assist the generation of the reference voltage). During a second time period different from the first time period, that operational amplifier 218 may perform a second function associated with a different circuit (e.g., buffers, filters, oscillators, voltage comparators, and/or any other circuits implemented with operational amplifiers). Such sharing of the operational amplifier 218 between different circuits improves area efficiency and lead to cost savings.

In some embodiments, an application circuit uses the buffered reference voltage provided at Vout 220 as a reference voltage. In such embodiments, the buffer errors associated with the operational amplifier 218 may be minimized within the error budget of that application circuit.

Figure 5A:
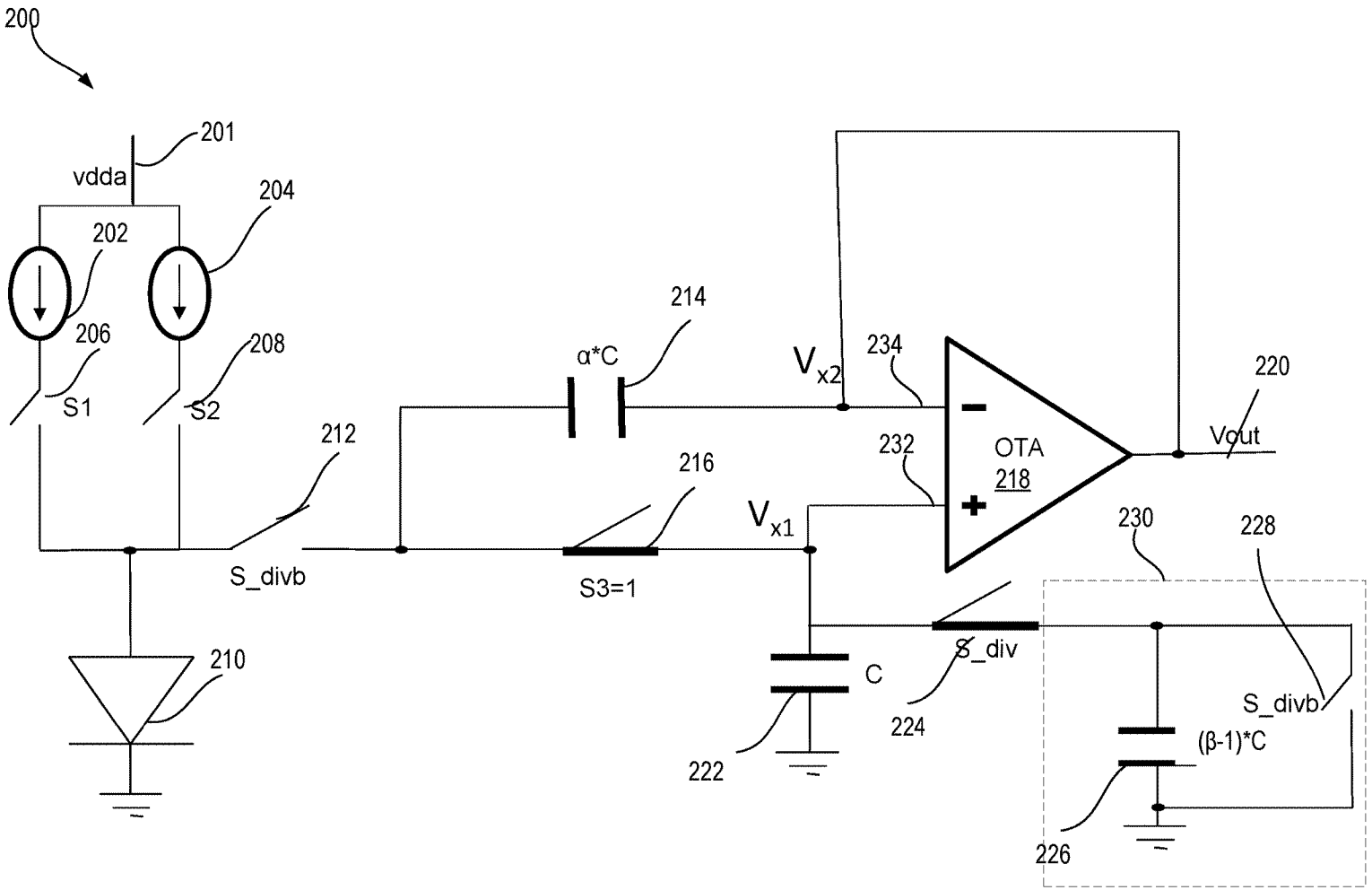
FIG. 5A is a block diagram illustrating an exemplary reference voltage circuit according to some embodiments of the present disclosure.

In the example of FIG. 5A, at block 156, during a third phase of the clock cycle, the states of the switches 208, 212, 216, 224, and 228 are changed. In some examples, at block 156, both switches 208 and 212 are off, such that the BJT 210 is coupled to neither of the first capacitor 222 and the second capacitor 214. In some examples, the switch 216 is on, such that the second terminal of the second capacitor 214 is coupled to the first terminal of the first capacitor 222. The switch 228 is off, and the switch 224 is on, such that the first capacitor 222 is coupled to the fraction control circuit 230. In the example of FIG. 5A, the first capacitor 222 is coupled to the capacitor 226 of the fraction control circuit 230 in parallel.

In some embodiments, the charges Q stored in the first capacitor 222 and the second capacitor 214 during the first phase at block 152 and the second phase at block 154 are redistributed on the first capacitor 222, the second capacitor 214, and the capacitor(s) (e.g., capacitor 226) in the fraction control circuit 230. In the example of FIG. 5A, the capacitor 226 has a capacitance (β−1)*C. The charges Q stored in the first capacitor 222 and the second capacitor 214 prior to the redistribution may be expressed as follows:

$$Q=\alpha*C*\Delta Vbe+C*Vbe1. \tag{1}$$

After the redistribution, the charges Q stored in the first capacitor 222, the second capacitor 214, and the capacitor(s) (e.g., capacitor 226) of the fraction control circuit 230 may be expressed as follows:

$$Q=(C+(\beta-1)*C)*V_{x1}+\alpha*C*(V_{x1}-V_{x2}), \tag{2}$$

wherein C is the capacitance of the first capacitor 222, (β−1)*C is the capacitance of the capacitor(s) of the fraction control circuit 230, α*C is the capacitance of the second capacitor 214, $V_{x1}$ is a voltage at the positive input 232 of the operational amplifier 218, and $V_{x2}$ is a voltage at the negative input 234 of the operational amplifier 218.

The following equation is provided by combining equations (1) and (2):

$$\alpha*C*\Delta Vbe+C*Vbe1=(C+(\beta-1)*C)*V_{x1}+\alpha*C*(V_{x1}-V_{x2}). \tag{3}$$

In some embodiments, a difference between $V_{x1}$ and $V_{x2}$ may depend on the accuracy requirement of the reference voltage. In some embodiments, $V_{x1}$ and $V_{x2}$ are substantially the same (e.g., by implementing high open loop gain, low offset, and/or auto-zeroing techniques in the operational amplifier 218). In other words, in such embodiments, $V_{x1}$ and $V_{x2}$ have substantially the same value and may be referred to as $V_x$. As such, equation (3) may be rewritten as follows:

$$\alpha*C*\Delta Vbe+C*Vbe1=\beta*C*V_x.$$

$V_{out}$ 220 and $V_x$ may be expressed as:

$$V_{out}=V_x=1/\beta*(Vbe1+a*\Delta Vbe),$$

where Vbe1+a*ΔVbe has a value of around the bandgap voltage (e.g., 1.2V), and 1/β is the fraction of the fractional bandgap voltage $V_{out}$.

In some embodiments, the reference voltage circuit 200 does not include a fraction control circuit 230 (e.g., β=1). In such embodiments, the reference voltage 220 may be expressed as Vbe1+a*ΔVbe, which is a bandgap voltage of about 1.2 volts.

As illustrated in FIG. 5A, in some embodiments, the reference voltage circuit 200 includes a fraction control circuit 230 (e.g., β>1). In such embodiments, the reference voltage 220 may be a fraction (e.g., 1/β) of the bandgap voltage, and may be referred to as a fractional bandgap voltage 220. The capacitor ratio β may be chosen to determine the ratio (fraction) between the reference voltage 220 and the bandgap voltage (e.g., about 1.2 volts), which may be determined depending on system architecture requirements (e.g., generic ADC full-scale requirements). In some examples, β is between about 1 and about 200 (e.g., 1.125, 10, 100). In an example, the capacitor 226 has a capacitance that is the same as the capacitance C of the first capacitor 222, and β equals two. In that example, the reference voltage is about 0.6 volt, which is about half of the bandgap voltage.

Figure 5B:
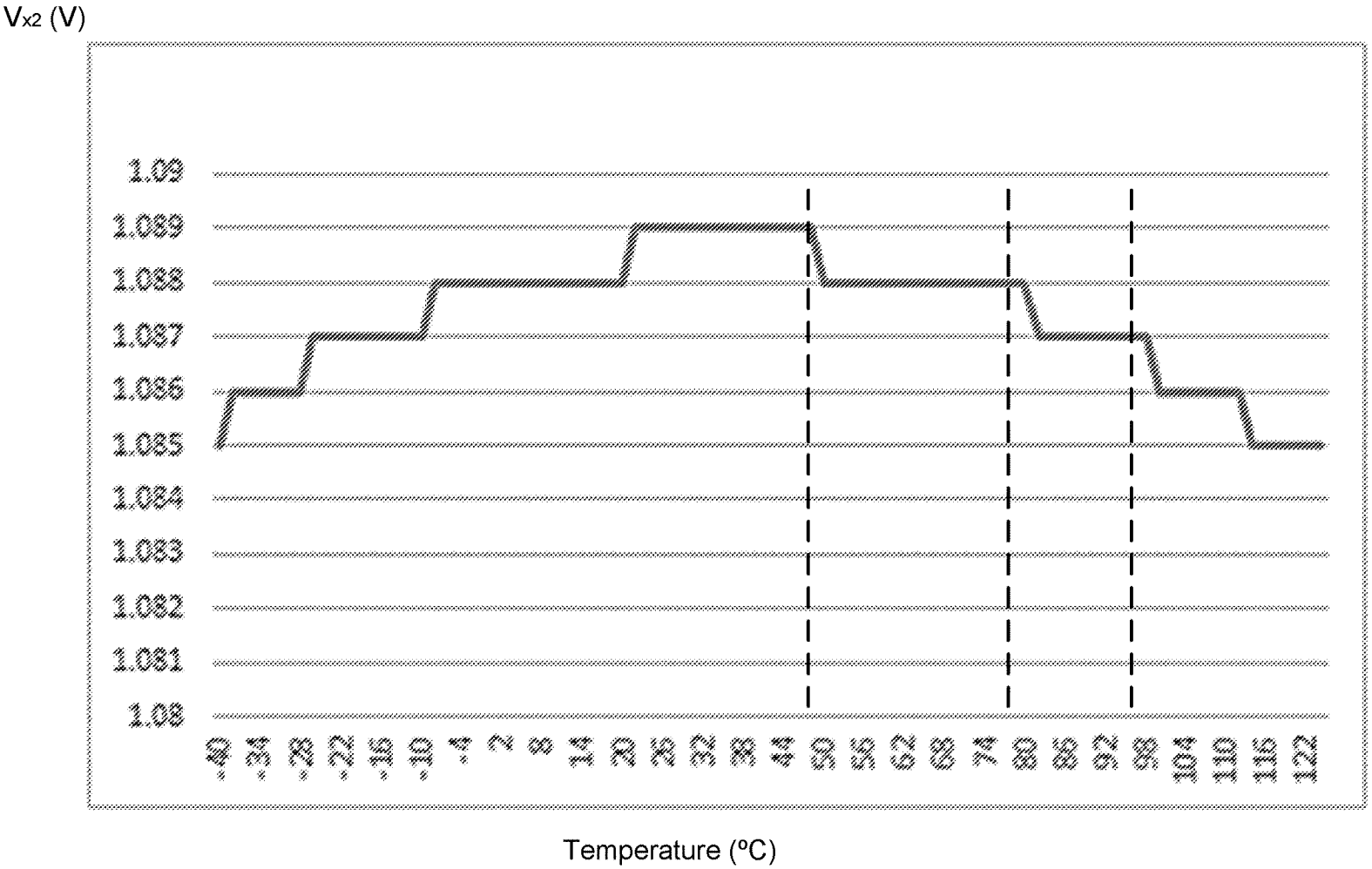
FIGS. 5B, 5C, and 5D illustrate performances of the exemplary reference voltage circuit of FIG. 5A according to some embodiments of the present disclosure.
Figure 5C:
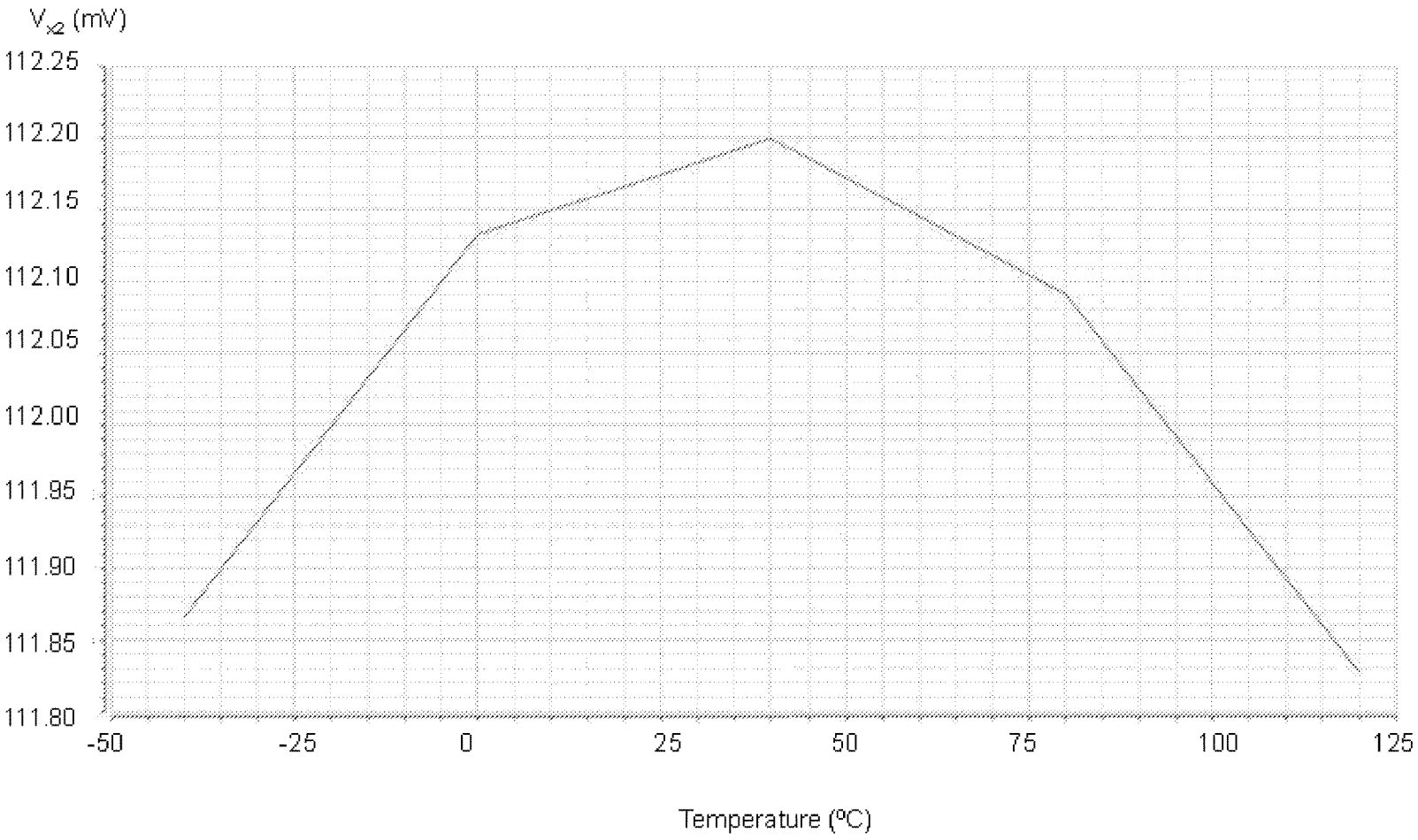
Figure 5D:
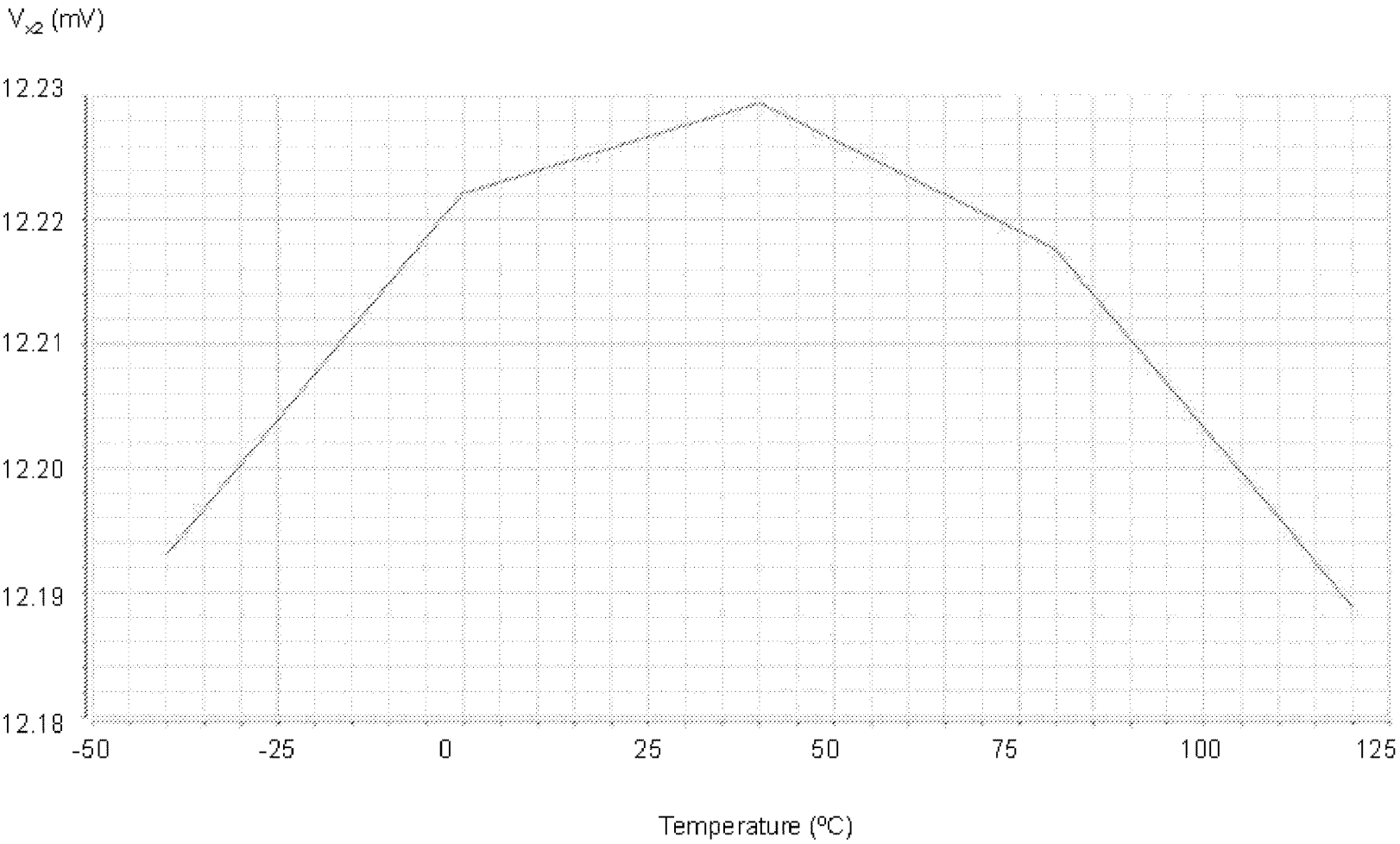

Referring to the examples of FIGS. 5B, 5C, and 5D, the value of β may be chosen based on the required range of the reference voltage (e.g., $V_{x2}$ or the buffered reference voltage Vout) provided by the reference voltage circuit. Referring to FIG. 5B, illustrated therein is an example of the reference voltage $V_{x2}$ of a reference voltage circuit 200 as a function of the temperature. In the particular example of FIG. 5B, the capacitor ration α is chosen to be about 9.7, and the capacitor ratio β is chosen to be about 1.125. As shown in FIG. 5B, the reference voltage $V_{x2}$ has first order temperature independence. For example, when the temperature is between about 50° C. and 80° C., the reference voltage $V_{x2}$ is about 1.088V. For further example, when the temperature is between about 80° C. and 98° C., the reference voltage $V_{x2}$ 220 is about 1.087V.

In some embodiments, a higher β may be chosen for providing a smaller reference voltage. Referring to the example of FIG. 5C, illustrated is a curve of the reference voltage as a function of the temperature where β has a value of about 10. As illustrated in FIG. 5C, the reference voltage $V_{x2}$ is in a range between about 111.8 mV to about 112.2 mV. Referring to the example of FIG. 5D, illustrated is a curve of the reference voltage as a function of the temperature where β has a value of about 100. As illustrated in FIG. 5D, the reference voltage is in a range between about 12.19 mV to about 12.23 mV. In some examples, careful low noise design of the operational amplifier may enable that a capacitor ratio β has a value even higher (e.g., higher than 100). In some examples, sampling the output reference voltage may desensitize the noise requirements.

It is noted that while FIGS. 3, 4, 5A, 5B, 5C, and 5D illustrate that different currents are injected into the same diode to generate different base-emitter voltages, in some embodiments, the same current may be injected into two different BJTs (e.g., having an emitter area ratio 1:M) to generate different base-emitter voltages, which may be used to generate a bandgap reference voltage. In such embodiments, a fraction control circuit substantially similar to the fraction control circuit 230 of FIGS. 3, 4, 5A, 5B, 5C, and/or 5D may also be used to generate a fraction of the bandgap reference voltage.

Figure 6:
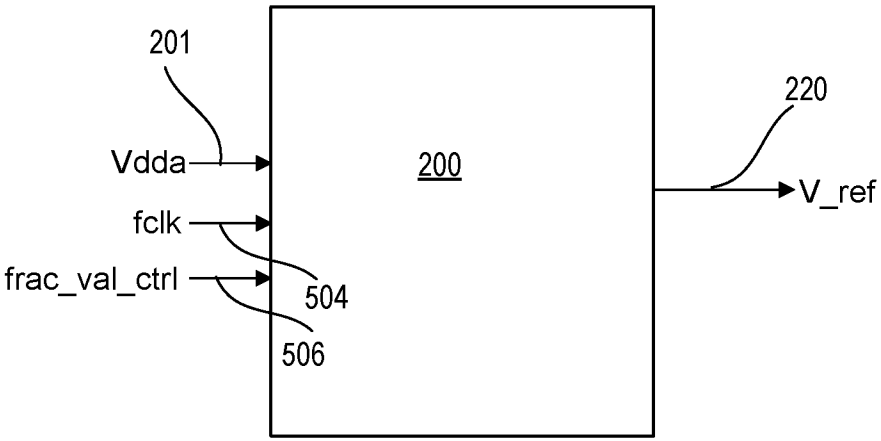
FIG. 6 is a block diagram illustrating an exemplary reference voltage circuit according to some embodiments of the present disclosure.
Figure 7:
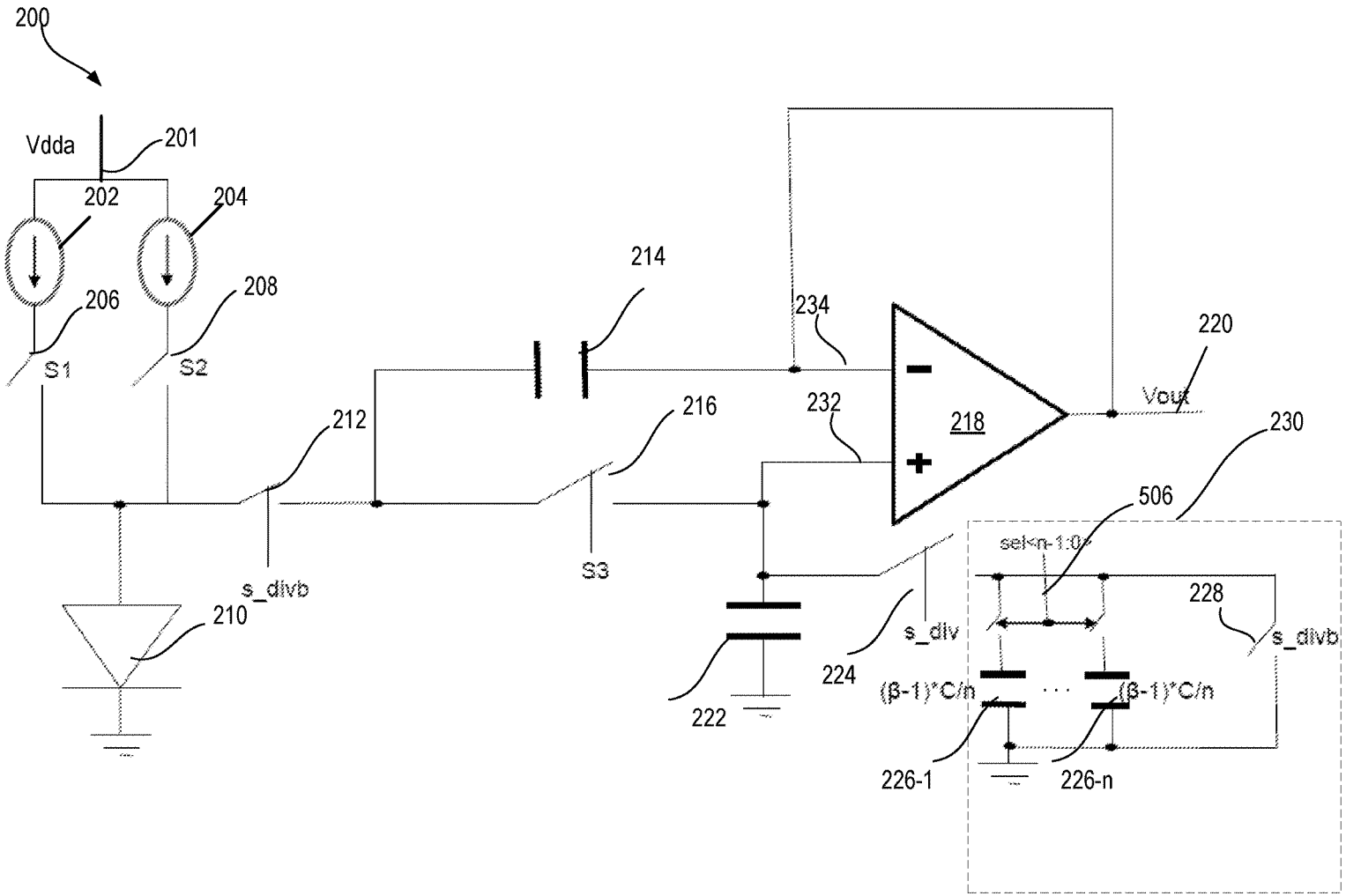
FIG. 7 is a block diagram illustrating an exemplary reference voltage circuit according to some embodiments of the present disclosure.

Referring to FIGS. 6 and 7, in some embodiments, the reference voltage circuit 200 receives a fraction control signal for controlling the fraction of the fractional bandgap voltage. Referring to FIG. 6, the reference voltage circuit 200 may receive Vdda 201 a first input, a clock signal 504 (fclk) at a second input, and a fraction control signal 506 at a third input. The reference voltage circuit 200 provides a fractional bandgap voltage 220 at an output. In some embodiments, the reference voltage circuit 200 may used as a digital-to-analog converter (DAC). For example, based on the digital fraction control signal 506 (e.g., defining a fraction of 1/n, where n is a positive integer), an equivalent analog voltage is generated and provided at the fractional bandgap voltage 220. The fractional bandgap voltage 220 may have a value of about Vbg/n, where Vbg is a bandgap voltage of about 1.2V, and may be generated using a unary capacitor array controlled by the fraction control signal 506.

Referring to FIG. 7, in some embodiments, the fraction control signal 506 is provided to the fraction control circuit 230 for controlling the capacitance of the fraction control circuit 230, thereby controlling the fraction of the fractional bandgap voltage 220. In the example of FIG. 7, the fraction control circuit 230 includes capacitors 226-1, . . . , **226-*i*, . . . , 226-*n* configured in parallel, wherein n is a positive integer. Each capacitor 226-*i*** has a capacitance (β−1)*C/n, and is coupled to a switch. The switch is controlled by a bit of the n-bit fraction control signal 506.

In an example, all the switches coupled to the capacitors 226-1, . . . , **226-*i*, . . . , 226-*n* are turned on according to the fraction control signal 506. In such an example, the fraction is 1/p, and the reference voltage 220 is about 1/β of the bandgap voltage. In another example, all of the switches coupled to the capacitors 226-1, . . . , 226-*i*, . . . , 226-*n* are turned off according to the fraction control signal 506. In such an example, the reference voltage 220 is equal to the bandgap voltage. In yet another example, N switches coupled to the capacitors 226-1, . . . , 226-*i*, . . . , 226-*n* are turned on according to the fraction control signal, where N is an integer between 0 and n. In such an example, the reference voltage 220** is about 1/(1+(β−1)*N/n) of the bandgap voltage. Accordingly, in the embodiment of FIG. 7, the fraction control signal 506 may be controlled such that a ratio (fraction) between the fractional bandgap voltage and the bandgap voltage is between about 1/β and 1. In an example, the resolution and/or choices of the fraction may be increased by increasing the number n, which is the number of parallel capacitors of the fraction control circuit 230.

In some embodiments, the circuit 200 of FIG. 7 may used as a digital-to-analog converter (DAC). For example, based on the digital fraction control signal 506 defining a fraction between about 1/β and 1, an equivalent analog voltage is generated and provided at the output 220, where the equivalent analog voltage has a value of the fraction (e.g., between about 1/β and 1) of the bandgap voltage (e.g., about 1.2V). The equivalent analog voltage may be generated by controlling the capacitor array 226-1, . . . , **226-*i*, . . . , 226-*n* and the associated switches using the digital fraction control signal 506**).

Figure 8:
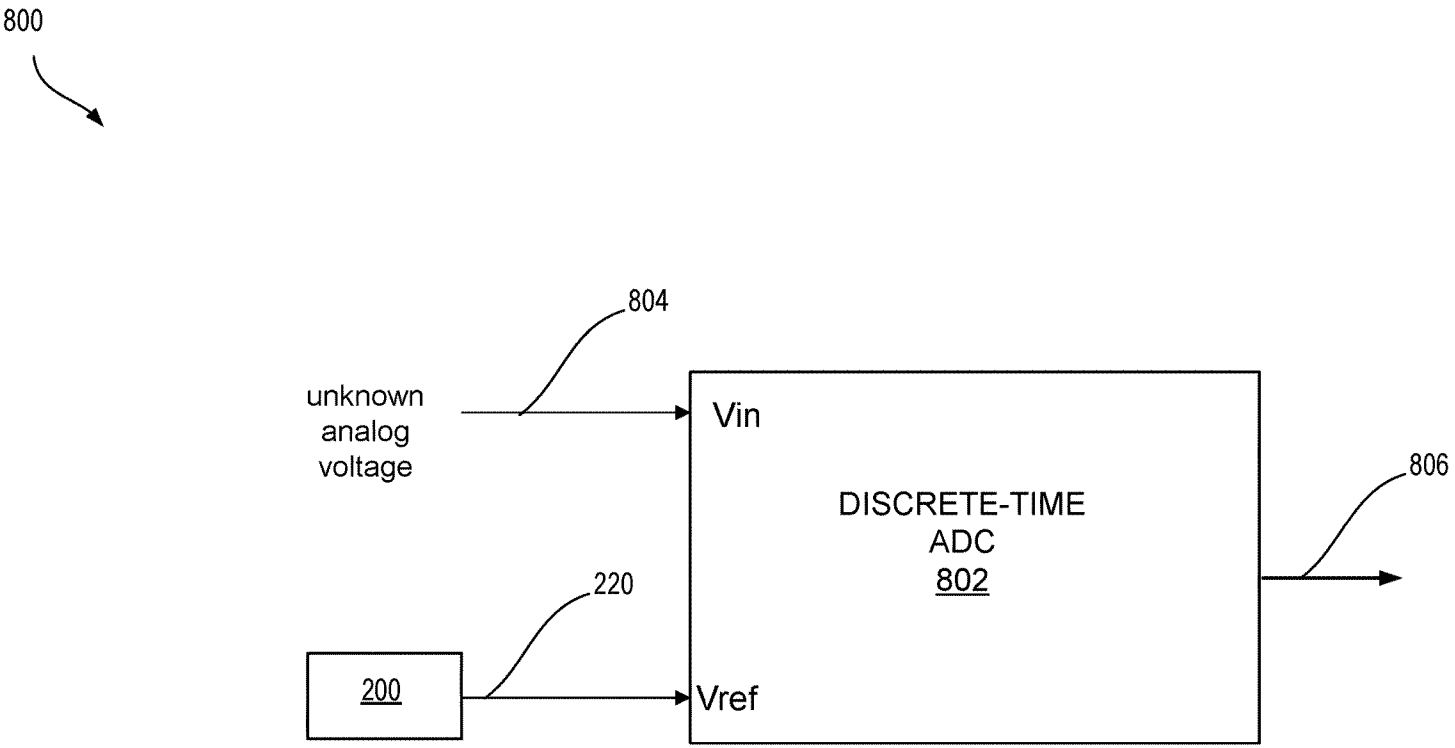
FIG. 8 is a block diagram illustrating an exemplary analog-to-digital converter (ADC) according to some embodiments of the present disclosure.
Figure 9:
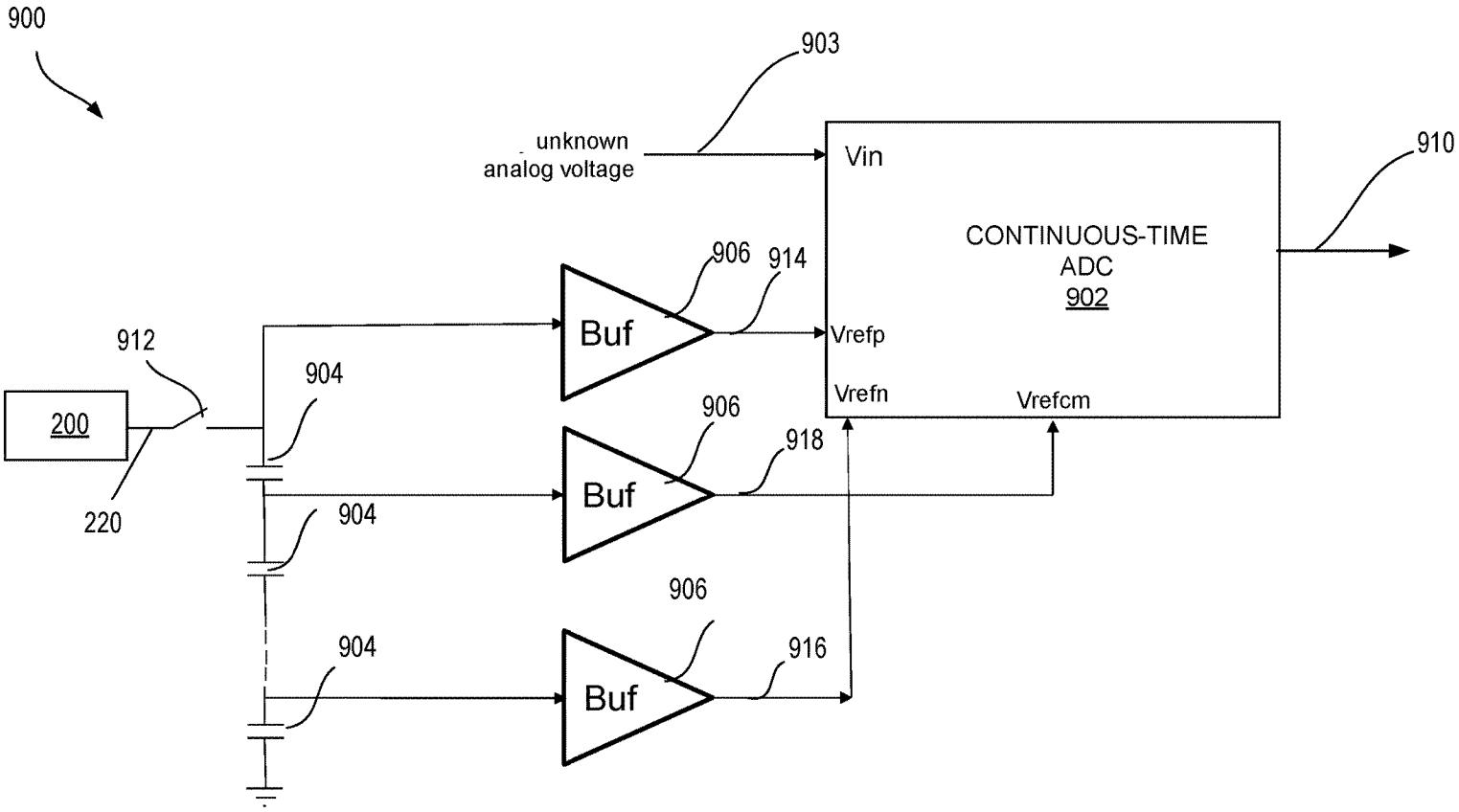
FIG. 9 is a block diagram illustrating an exemplary analog-to-digital converter (ADC) according to some embodiments of the present disclosure.
Figure 10:
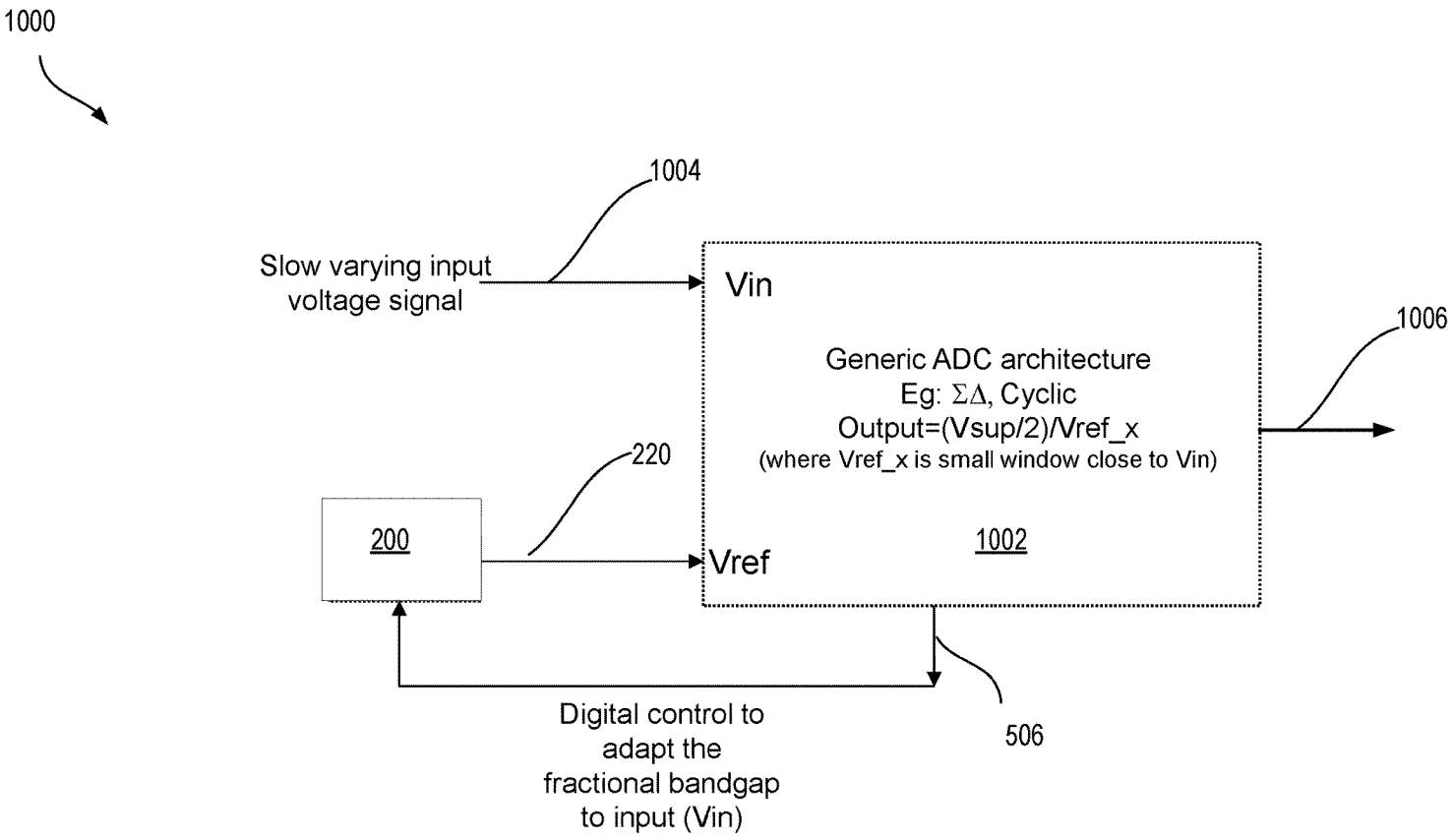
FIG. 10 is a block diagram illustrating an exemplary analog-to-digital converter (ADC) according to some embodiments of the present disclosure.

Referring to FIGS. 8, 9, and 10, the reference voltage circuit 200 may be used in various applications, including for example, a generic discrete ADC system, a generic continuous ADC system, and an instrumentation (low-frequency) ADC system requiring a dynamic reference voltage signal.

Referring to the example of FIG. 8, illustrated is a discrete-time ADC system 800 including a discrete-time ADC 802. The discrete-time ADC 802 may be a discrete-time ADC of various types (e.g., generic ADC, ΣΔADC, cyclic ADC). The discrete-time ADC 802 receives an input analog voltage signal 804 at its input $V_{in}$, and receives a reference voltage signal 220 from a reference voltage circuit 200 at its input Vref. The discrete-time ADC 802 uses the reference voltage signal 220 to generate a digital signal 806 representing the input analog voltage signal 804.

Referring to the example of FIG. 9, illustrated is a continuous-time ADC system 900 including a continuous-time ADC 902. The continuous-time ADC 902 may be a continuous-time ADC of various types (e.g., generic ADC, ΣΔADC, cyclic ADC). The continuous-time ADC 902 receives an input analog voltage signal 903 at its input $V_{in}$.

In some embodiments, the continuous-time ADC system 900 receives a reference voltage signal 220 from a reference voltage circuit 200. The reference voltage signal 220 may be coupled to capacitors 904 and buffers 906 through a switch 912, and be used to generate a plurality of reference voltages including for example, Vrefp 914, Vrefn 916, and Vrefcm 918. In some examples, a range between Vrefp 914 and Vrefn 916 may represent the full scale range of the continuous-time ADC 902. The voltage Vrefcm 918 may be set to a common mode voltage that resides between Vrefp 914 and Vrefn 916, e.g., at a voltage of about (Vrefp 914+Vrefn 916)/2. The continuous-time ADC 902 uses the reference voltage signals Vrefp 914, Vrefn 916, and Vrefcm 918 to generate a digital signal 910 representing the input analog voltage signal 903.

Referring to FIG. 10, illustrated therein is an instrumentation ADC system 1000 using a dynamic reference voltage signal. The instrumentation ADC system 1000 includes an ADC 1002, which may be an ADC of various types (e.g., generic ADC, ΣΔADC, cyclic ADC). The ADC 1002 receives an input analog voltage signal 1004 having a low frequency at its input $V_{in}$, and receives a reference voltage signal 220 (also referred to as a fractional bandgap voltage 220) from a reference voltage circuit 200 at its input Vref. The ADC 1002 provides a digital fraction control signal 506 determined based on the input analog voltage signal 1004 received at the input V. In some embodiments, the ADC 1002 chooses the digital fraction control signal 506 such that the reference voltage signal 220 controlled by the chosen digital fraction control signal 506 is the closest to the input analog voltage signal 1004 (e.g., using a binary or unary search mechanism) among all possible digital fraction control signal choices. By using such reference voltage signal 220 close to the input analog voltage signal 1004, the dynamic range usage of the ADC 1002 may be increased. The digital fraction control signal 506 may be used to control the fraction of the fractional bandgap voltage 220 (e.g. by controlling the capacitance of the fraction control circuit 230), thereby controlling the reference voltage signal 220 to be within a small window of the input analog voltage signal 1004. The ADC 1002 uses the reference voltage signal 220 to generate a digital signal 1006 representing the input analog voltage signal 1004.

It is noted that various configurations (e.g., I1, I2, M, C, Vdda, n, N, α, β, configurations of the ADC) illustrated in FIGS. 2-10 are exemplary only and not intended to be limiting beyond what is specifically recited in the claims that follow. It will be understood by those skilled in that art that other configurations may be used.

Various advantages may be present in various applications of the present disclosure. No particular advantage is required for all embodiments, and different embodiments may offer different advantages. One of the advantages in some embodiments is that by injecting different currents into a BJT during different phases of a clock cycle, temperature-independent reference voltages may be generated using a reference voltage circuit including one BJT. This saves area of the reference voltage circuit, lowers the power supply voltage, and reduces inaccuracy resulting from mismatched components. Another advantage in some embodiments is that the reference voltage circuit uses switched capacitor circuit techniques to generate the reference voltage, which further improves accuracy because capacitor ratios in deep sub-micron technology are well matched. Yet another advantage is that a single topology is used to generate any fraction of a bandgap voltage. The fraction may be digitally controlled by a fraction control signal dynamically. This may be especially useful where the analog-to-digital conversion (e.g. in a generic instrumentation ADC) requires that the reference voltage is adapted according to the input signal of the ADC.

Although particular embodiments have been shown and described, it will be understood that it is not intended to limit the claimed inventions to the preferred embodiments, and it will be obvious to those skilled in the art that various changes and modifications may be made without department from the spirit and scope of the claimed inventions. The specification and drawings are, accordingly, to be regarded in an illustrative rather than restrictive sense. The claimed inventions are intended to cover alternatives, modifications, and equivalents.

What is claimed is:

1. An integrated circuit, comprising:

a reference voltage circuit including:

a bipolar junction transistor (BJT) configured to:

receive a first current during a first phase of a clock cycle to generate a first base-emitter junction voltage; and receive a second current during a second phase of the clock cycle to generate a second base-emitter junction voltage; and a switched capacitor circuit configured to provide a reference voltage associated with the first base-emitter junction voltage and the second base-emitter junction voltage.

2. The integrated circuit of claim 1, wherein the reference voltage circuit is coupled to a supply voltage less than about 1.5 volts.

3. The integrated circuit of claim 1, wherein the reference voltage circuit includes:

an operational amplifier having a first input, a second input, and an output, wherein the first input of the operational amplifier is coupled to the first capacitor, wherein the second input of the operational amplifier is coupled to the second capacitor, and wherein the output of the operational amplifier provides the reference voltage.

4. The integrated circuit of claim 1, wherein the reference voltage is equal to or less than a bandgap voltage of about 1.2 volts.

5. The integrated circuit of claim 4, wherein the reference voltage circuit includes a fraction control circuit coupled to the first capacitor, and wherein the fraction control circuit is configured to determine a ratio of the reference voltage to the bandgap voltage.

6. The integrated circuit of claim 5, wherein the fraction control circuit includes:

one or more fraction control capacitors, each fraction control capacitor coupled to a fraction control switch;

wherein the fraction control circuit is configured to receive a fraction control signal, and wherein each fraction control switch is controlled by a bit of the fraction control signal.

7. The integrated circuit of claim 6, wherein the reference voltage is first order temperature independent.

8. The integrated circuit of claim 7, wherein the integrated circuit includes an analog-to-digital converter (ADC) having a first input, a second input, and a first output;

wherein the first input of the ADC is configured to receive an analog voltage signal, wherein the second input of the ADC is configured to receive the reference voltage, and wherein the first output of the ADC provides a digital signal corresponding to the analog voltage signal.

9. The integrated circuit of claim 8, wherein the ADC includes a second output providing the fraction control signal to the fraction control circuit.

10. A method, comprising:

receiving, by a bipolar junction transistor (BJT), a first current during a first phase of a clock cycle to generate a first base-emitter junction voltage;

receiving, by the BJT, a second current during a second phase of the clock cycle to generate a second base-emitter junction voltage; and providing, by a switched capacitor circuit, a reference voltage associated with the first base-emitter junction voltage and the second base-emitter junction voltage, wherein the providing the reference voltage associated with the first base-emitter junction voltage and the second base-emitter junction voltage includes:

storing, by a first capacitor of the switched capacitor circuit, a first charge associated with the first base-emitter junction voltage during the first phase;

storing, by a second capacitor of the switch capacitor circuit, a second charge associated with a difference between the first and second base-emitter junction voltage during the second phase; and redistributing, the between the first and second capacitors, the first charge and second charge during a third phase of the clock cycle.

11. The method of claim 10, further comprising:

receiving a supply voltage less than about 1.5 volts.

12. The method of claim 10, further comprising:

coupling the first capacitor to a first input of an operational amplifier;

coupling the second capacitor to a second input of the operational amplifier; and providing the reference voltage using an output of the operational amplifier.

13. The method of claim 10, wherein the reference voltage is equal to or less than a bandgap voltage of about 1.2 volts.

14. The method of claim 13, further comprising:

determining a ratio of the reference voltage to the bandgap voltage using a fraction control circuit coupled to the first capacitor.

15. The method of claim 14, further comprising:

receiving, by the fraction control circuit, a fraction control signal;

wherein the fraction control circuit includes one or more fraction control capacitors, each fraction control capacitor coupled to a fraction control switch; and wherein each fraction control switch is controlled by a bit of the fraction control signal.

16. The method of claim 15, wherein the reference voltage is first order temperature independent.

17. The method of claim 16, further comprising:

providing an analog signal to a first input of an analog-to-digital converter (ADC);

providing the reference voltage to a second input of the ADC; and generating, through a first output of the ADC, a digital signal corresponding to the analog signal.

18. The method of claim 17, further comprising:

receiving, by the fraction control circuit from the ADC, the fraction control signal.

* * * * *